United States Patent [19]

Hruda

[11] 4,348,567

[45] Sep. 7, 1982

[54] LOW-VOLTAGE VACUUM SWITCH OPERATING MECHANISM

[75] Inventor: Robert M. Hruda, Horseheads, N.Y.

[73] Assignee: Westinghouse Electric Corp., Pittsburgh, Pa.

[21] Appl. No.: 162,265

[22] Filed: Jun. 23, 1980

[51] Int. Cl.[3] ..... H01H 33/66

[52] U.S. Cl. ..... 200/144 B

[58] Field of Search ..... 200/144 B

[56] References Cited

U.S. PATENT DOCUMENTS 4,216,359 8/1980 Hruda ..... 200/144 B

*Primary Examiner*—Robert S. Macon

*Attorney, Agent, or Firm*—W. G. Sutcliff

[57] ABSTRACT

An improved low voltage vacuum switch assembly and operating mechanism is disclosed for use as an electrically parallel shunting switch for an electrolytic cell. The improved switch assembly and operating mechanism includes linking means restraining guide means associated with a reciprocably movable linking means to restrain the linking means to essentially axial or reciprocable movement. This prevents any accidental switch contact closing as during installation.

4 Claims, 2 Drawing Figures

LOW-VOLTAGE VACUUM SWITCH OPERATING MECHANISM

BACKGROUND OF THE INVENTION

The present invention is directed to an improved low-voltage vacuum switching device and operating mechanism which is typically used as an electrolytic cell shorting assembly. Such a vacuum switch and operating mechanism is described in U.S. Pat. No. 4,216,359 filed June 13, 1978 entitled "Low-Voltage Vacuum Switch And Operating Mechanism", owned by the assignee of the present invention. This earlier switch and operating mechanism has found significant application as an electrical shunting switch assembly for use with high current carrying electrolytic cells, as a parallel shunt across the terminals of the cell. The switch has a very compact physical profile and short axial contact travel distance. The switch is operated, i.e. opened and closed by means of a small axial movement which is produced by translating a rotational operating shift motion via an eccentric cam to a reciprocating connecting link which acts upon one end of the switch. The switch and operating assembly is a contact, rugged design for use in low-voltage, high-current, severe environment applications.

In the prior switch assembly a plurality of electrically parallel vacuum switches are operated from a common rotating shaft. Individual eccentric cam means are mounted on the shaft and connected to reciprocatable linking means to operate the individual switches. It is generally desired to open and close the switches as nearly simultaneously as possible. When the linking means have some lateral movement capability which can cock the switch contacts, it is difficult to ensure simultaneous contact operation for the plurality of switches. The eccentric cam means is configured so that rotation through a specific angle, i.e. the opening angle, will simultaneously operate the paralleled switches. Any variable lateral movement of the linking means relative to the respective switches makes the setting and selection of the opening angle more difficult.

The switch assembly of the present invention is either permanently connected across the cell terminal, or may be a portable assembly which can be connected and disconnected as a shunt across an individual cell. The cell terminals carry currents of terms of thousands of amperes and significant thermal heating and expansion of these conductors can be expected. When the switch assembly is connected to such thermally affected conductors, and the linking means has lateral movement capability there can be switch contact cocking and accidental switch contact closing.

SUMMARY OF THE INVENTION

An improved low-voltage vacuum switch and operating mechanism consists of a linking means restraining guide means disposed on opposed transverse sides of the operating mechanism linking means. These guide means limit and restrain the transverse movement of linking means as the operating shaft and eccentric are rotated to move the linking means in essentially an axial direction.

The present invention utilizes the earlier low-voltage vacuum switch and operating mechanism with an improvement which limits transverse movement of the linking means to limit and restrain the movement of the linking means to the axial direction to effectuate opening and closing of switch contacts. This structural improvement adapts the operating mechanism to translate the rotary motion of the drive shaft to an essentially axial motion of the connecting linking means to the vacuum switch contacts. The present improvement is desirable to prevent any accidental contact closure within the vacuum switch due to lateral or transverse forces such as may be applied during switch installation, or during the initial switch closing movement of the connecting linking means. Any lateral movement tends to produce a slight cocking of the switch contacts from their generally planar relationship, and may result in premature switch contact closing.

DESCRIPTION OF THE PREFERRED EMBODIMENTS

Figure 1:
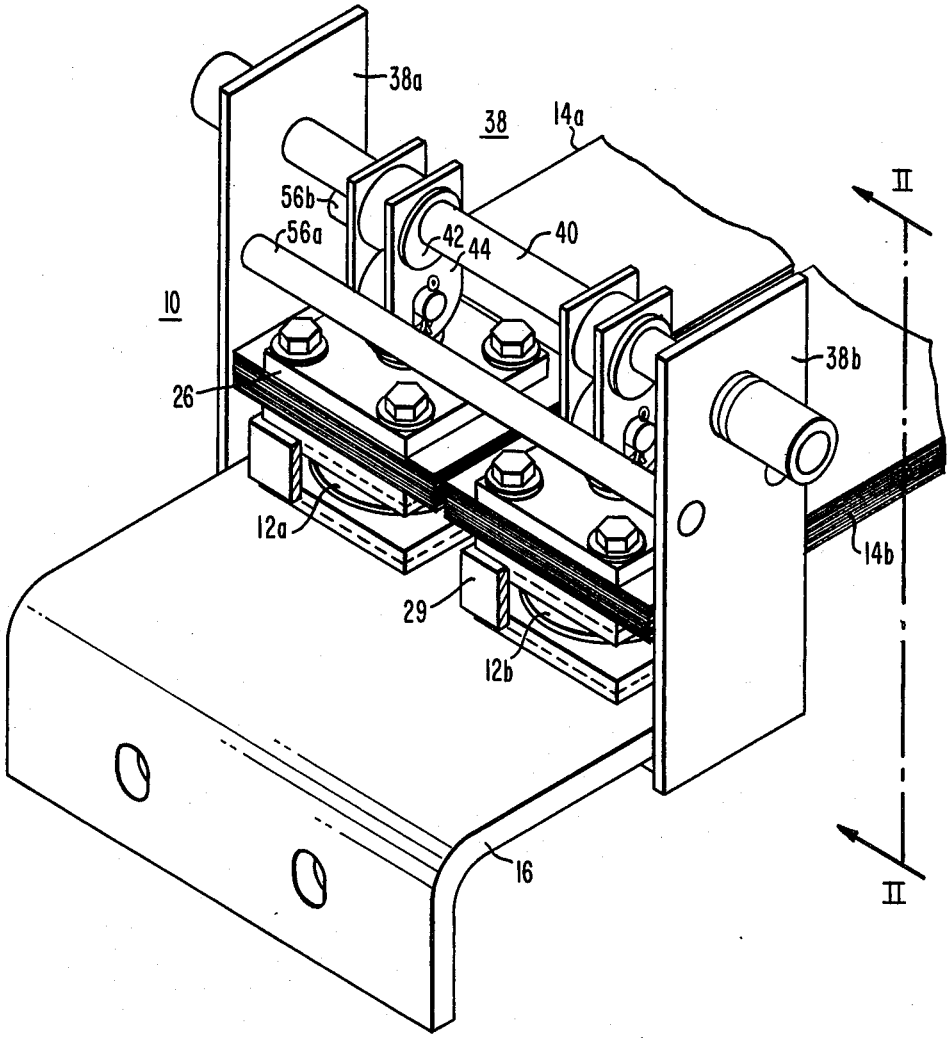
FIG. 1 is a perspective side view of the improved low-voltage vacuum switching means and operating mechanism for the present invention.
Figure 2:
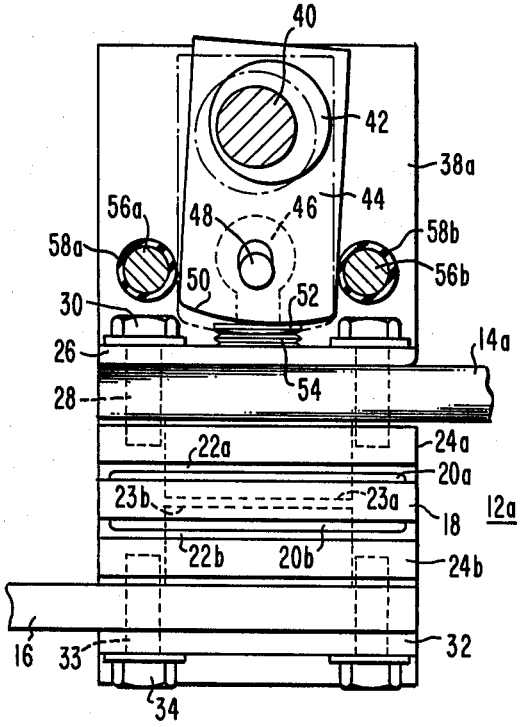
FIG. 2 is a side-elevational view taken from one end of the embodiment seen in FIG. 1 viewed along the lines II—II with the frame member removed from the end from which the view is had.

The invention is best understood by reference to the embodiments seen in FIGS. 1 and 2. The low-voltage vacuum switch means and operating mechanism 10 as seen in FIG. 1 includes two low-voltage vacuum switch modules 12*a* and 12*b* connected between flexible bus connectors 14*a* and 14*b* which lead to one terminal of the electrolytic cell (not shown). The other side of the vacuum switches are connected to a common rigid bus 16 which is connectable to the other terminal of the electrolytic cell. The low-voltage vacuum switch modules 12*a* and 12*b* are perhaps best described and understood by reference to the aforementioned U.S. Pat. No 4,216,359 the teachings of which are incorporated herein by reference. The low-voltage vacuum switch will be described with respect to a single switch 12*a* with the other switch 12*b* being identical thereto. The switch module 12*a* comprises an annular ceramic insulating body portion 18. The opposed end surfaces of this insulated body portion 18 are metalized by a conventional process and a pair of thin, flexible, annular diaphragm members 20*a*, 20*b* are sealed to the metalized end surface. The annular members 20*a* and 20*b* are thin, metal diaphragms having a plurality of annular corrugations formed therein. The annular corrugations of the member 20*a*, 20*b* permit the flexing of this annular member in a generally axial direction. The inner diameter of the annular members 20*a*, 20*b* are sealed to cylindrical conductive support posts 22*a*, 22*b*. The outer perimeter portions of the flexible annular members 20*a* and 20*b* are sealed to the metalized coating on the insulating body ring. The ceramic insulating body portion 18, the flexible annular diaphragm members 20*a* and 20*b*, and the cylindrical conductive supports posts 22*a* and 22*b* comprise the hermetically sealed envelope for the vacuum switch. Weld resistant contact discs 23*a* and 23*b* are disposed on the respective interior ends of the support posts 22*a* and 22*b* within the vacuum switch. Planar mounting plates 24*a*, 24*b* have support post receiving apertures therethrough and are brazed to the conductive support posts proximate the exterior extending ends of the support posts. The support posts protrude a small distance through the planar mounting plates to permit their electrical connection to the respective rigid bus 16 and flexible buses 14*a* and 14*b*.

An auxiliary planar mounting plate 26 is provided atop the flexible bus 14 and aligned apertures 28 through the auxiliary mounting plate 26, the flexible bus 14 and the planar mounting plate 24*a*, accept bolt means 30 for connecting these members together. In the same manner a second auxiliary plate 32 is disposed beneath the rigid support bus 16 and apertures 33 are provided through the auxiliary plate 32, the rigid bus 16, and aligned with threaded apertures in the lower mounting plate member 24*b* to permit bolt means 34 to connect these members together.

The rigid bus connector 16 is connected to a frame member 38*a* and 38*b* at either side of the bus and two switch modules. The flexible bus member 14*a* permits axial movement of the switch contacts together and away from each other upon application of an axial, or here a vertical force. A thin protective, insulating, elastomer band 29 may be disposed about the vacuum switches 12*a*, 12*b* as seen in FIG. 1, where the band 29 is shown broken away for clarity. This band 29 is supported from the mounting plates 24*a*, 24*b*, and keeps corrosive material from contacting the annular diaphragm members 20*a*, 20*b* and the seal areas of the switches. The band 29 is not shown in FIG. 2.

An axial force is applied to the low voltage switch to either move the contacts together and close the contacts in mating engagement, or to move them apart to an open circuit position. The flexible annular diaphragm members provide the requisite flexibility of the switch envelope to permit such axial movement. The flexible annular diaphragm members also permit some slight cocking from a planar relationship of the support posts and contact surfaces to facilitate breaking of welds which may have formed between the contacts during closed circuit, high-current carrying contact operation. The fact that the annular diaphragm members extend generally normal to the switch axis, which is the direction of contact movement, keeps this off-axis cocking to a minimum but still permits it to a certain extent for weld breaking of the contacts. As will be explained hereafter, the improved structure of the present invention further limits this non-axial cocking of the switch contacts to prevent accidental switch closing.

The vacuum switch operating mechanism 38 is designed to operate both of the vacuum switches 12*a* and 12*b* approximately simultaneously, and can be ganged with additional switch modules to be simultaneously driven and operated with other groups of switches. The operating mechanism 38 includes a rotatable operating shaft 40 which is supported from spaced-apart frame members 38*a*, 38*b*. An eccentric cam means 42 is mounted on the rotatable shaft 40 so that the eccentric cam 42 turns with the shaft. Insulating connecting link means 44 are spaced apart and extend from the eccentric cam means via apertures provided through the link means 44 toward the auxiliary plate member 26 mounted on the flexible bus connector. The cam means 42 is rotatable to produce a reciprocal movement of the link means 44 along the longitudinal axis of the switch. The auxiliary mounting plate 26 has an eye bolt 46 extending generally upwardly from plate 26 which eye bolt fits between the spaced-apart linking means 44. Apertures are provided in the spaced-apart linking means 44 aligned with the eye bolt and a connecting pin 48 is fitted through the aligned apertures to connect this eye bolt to the linking means. The aligned apertures in the linking means are elongated in the vertical direction so that the pin can move up and down as the linking means move in a generally reciprocal axial direction. The linking means 44 have generally arcuate-shaped bottom end surfaces 50 which seat on an enlarged washer means 52 disposed below the eye portion of the eye bolt. A plurality of dished washers 54, such as Belleville washers, are disposed under the enlarged washer 52 to act as an overtravel spring means and are disposed atop the auxiliary mounting plate 26.

As can be readily seen from FIG. 2, the linking means 44 with the arcuate end surfaces 50 are generally reciprocally or axially movable from a dashed line indicated closed switch contact position to a solid line indicated open switch contact position. There had been some rocking or lateral translational motion associated with movement of the linking means in the prior art design from the closed position to the open position and vice versa. It is the object of the present invention to limit this lateral translational movement of the linking means and to limit and restrain it to essentially an axial direction. To this end a pair of linking means restraining guide means 56*a*, 56*b* are seen here as rods extending between the spaced-apart frame members 38*a*, 38*b* on either side of the linking means 44. The linking means restraining guide means 56*a*, 56*b* or rods are spaced apart by a dimension which slightly exceeds the width of the linking means. The guide means 56*a*, 56*b* are preferably spaced apart by a dimension of about 10 mils greater than the transverse width of the linking means. The guide means or rods are typically $\frac{3}{4}$ inch diameter steel rods which have an insulating layer 58*a*, 58*b* respectively thereon to prevent any accidental shorting between the rod and the upper end of the vacuum switch and associated bus conductors. As can be appreciated from FIG. 2 when the vacuum switches are in the open circuit position as indicated by the solid lines for the linking means, there can be a slight lateral force on the upper contact of the vacuum switch due to the eccentricity of the eccentric cam means. This results in a slight cocking of the upper contact of the vacuum switch. This cocking or deviation from planar relationship between the contacts is desirable to break welds between the contacts with some type of contact materials. The guide means of the present invention restrain this cocking or transverse movement of the linking means and the cocking of the switch contacts. In this way the possibility of accidental contact closing due to the application of lateral force on the operating mechanism or switch is avoided. The installation of such switch assemblies across the terminals of an operating, high current carrying cell is frequently carried out with the switch in the open position. The switch is thus vulnerable in accidental closing resulting from a transverse force applied during installation. During installation power is typically on the bus conductors to which the switch assembly is being connected, so that accidental switch closing is a hazard to the installer.

An additional advantage of the present structure is to allow more accurate setting of the eccentric cam opening angle, since any significant cocking of the contact surfaces would effect the angle at which contact closing would take place due to lateral movement of the linking means.

A further advantage of the present structure is the elimination of the possibility that thermal expansion of the current carrying bus bars during normal cell operation will cause cocking of the switch contacts and non-intended switch contact closing.

The present structure which restrains lateral movement of the linking means and cocking of the contacts simplifies field installation. The switch assembly is installed by first correcting the rigid bus conductor to the cell terminal with the vacuum switches in the open position. In the open contact position the contacts are in spaced apart planar relationship, with less than a 0.25 inch and typically only about 0.125 inch spacings. When the final connection of the flexible bus conductor is being made between the vacuum switches and the cell terminal, it is not unusual for the installer to apply lateral force to the flex to get the connection points aligned. Such lateral force could accidentally result in closing the switch contacts by cocking as explained earlier. The present structure minimizes this problem by restraining lateral movement of the linking means, and thereby minimizes accidental switch closings. The switch is installed to an operating system with current flowing through the cell and cell terminals, and accidental switch closings are a hazard to the installer.

I claim:

1. An improved low-voltage vacuum switching means and operating mechanism including at least one low-voltage vacuum switch which includes axially movable contacts, which switch is connected via eccentric means to a rotary motion operating mechanism by linking means for translating the rotary motion to axial motion, which linking means has one end connected to the eccentric means, with the opposed linking means end pivotally connected to one axially movable contact of the low-voltage switch, which linking means is axially movable with rotation of the eccentric means to effect opening and closing of the switch contacts, and wherein the linking means can move in a direction transverse to the axial movement direction as the eccentric means is rotated.

the improvement wherein linking means restraining guide means are disposed on opposed transverse sides of the linking means to limit and restrain the transverse movement of the linking means as the eccentric is rotated to move the linking means in essentially an axial direction.

2. The improved low-voltage vacuum switching means and operating mechanism set forth in claim 1, wherein the linking means restraining guide means comprise a pair of parallel rods spaced apart by a distance sufficient to permit axial linking means movement.

3. The improved low-voltage vacuum switching means and operating mechanism set forth in claim 2, wherein the spaced-apart parallel rods are rigidly supported from a switching means and operating mechanism support frame.

4. The improved low-voltage vacuum switching means and operating mechanism set forth in claim 2, wherein the spaced-apart parallel rods are metal rods sheathed with an insulating covering.

* * * * *